US007857738B2

(12) United States Patent
Reyes

(10) Patent No.: US 7,857,738 B2
(45) Date of Patent: Dec. 28, 2010

(54) HIP FLEXOR

(75) Inventor: Gil Reyes, Las Vegas, NV (US)

(73) Assignee: GRAA Innovations, LLC, Las Vegas, NV (US)

( * ) Notice: Subject to any disclaimer, the term of this patent is extended or adjusted under 35 U.S.C. 154(b) by 33 days.

(21) Appl. No.: 12/229,477

(22) Filed: Aug. 21, 2008

(65) Prior Publication Data

US 2010/0048364 A1 Feb. 25, 2010

(51) Int. Cl.
*A63B 21/04* (2006.01)

(52) U.S. Cl. ..... 482/130; 482/121

(58) Field of Classification Search ..... 482/133–136, 482/121–130, 904, 908, 100, 137, 145, 23, 482/41; 108/144.11, 108, 146, 147.16–147.17; 211/126.5, 133.3, 173–174; 248/125.1, 157, 248/161; 280/87.021
See application file for complete search history.

(56) References Cited

U.S. PATENT DOCUMENTS

| | | | | |
|---|---|---|---|---|
| 1,902,694 | A | 3/1933 | Edwards | |
| 3,116,062 | A | 12/1963 | Zinkin | |
| 3,465,750 | A | 9/1969 | Schawalder | |
| 4,176,836 | A | 12/1979 | Coyle | |
| 4,340,218 | A | 7/1982 | Wilkinson | |
| 4,500,089 | A | 2/1985 | Jones | |
| 4,645,200 | A | 2/1987 | Hix | |
| 4,711,448 | A | 12/1987 | Minkow et al. | |
| 4,749,184 | A | 6/1988 | Tobin | |
| 4,796,881 | A | 1/1989 | Watterson | |
| 4,804,180 | A | 2/1989 | Salaz | |
| 4,809,976 | A | 3/1989 | Berger | |
| 5,407,414 | A * | 4/1995 | Bass | 482/129 |
| 5,672,143 | A | 9/1997 | Ish | |
| 5,800,323 | A * | 9/1998 | Ansel | 482/129 |
| 7,481,751 | B1 | 1/2009 | Arnold | |
| 2002/0137607 | A1 | 9/2002 | Endelman | |
| 2006/0100070 | A1 * | 5/2006 | Abdo | 482/121 |
| 2009/0197746 | A1 | 8/2009 | Splane et al. | |

* cited by examiner

*Primary Examiner*—Lori Baker
(74) *Attorney, Agent, or Firm*—Weide & Miller, Ltd.

(57) ABSTRACT

A hip flexor is a resistance training device used for training or rehabilitating the muscles and other body structures of the hip and thigh. The hip flexor comprises a frame with a hip actuator having an actuator arm which rotates about a pivot. One or more springs or other resistance devices provide resistance against a user's motion to train or rehabilitate the user's hip and thigh muscles. The position of the hip actuator and the amount of resistance, the variability of the resistance, or both may be adjusted as desired. During training, a user engages the actuator arm with his or her thigh and actuates the actuator arm against the resistance provided by the one or more springs. Training may be focused on various muscles of the thigh.

23 Claims, 8 Drawing Sheets

HIP FLEXOR

BACKGROUND OF THE INVENTION

1. Field of the Invention

The invention relates to a resistance training device for training the lower extremities and more specifically muscles and other structures of the hip.

2. Related Art

Resistance training can generally be thought of as a form of training where physical resistance against muscle movement is used to strengthen and build muscle. Resistance training benefits to overall health, and is the basis of many forms of rehabilitation and athletic training.

The benefits of resistance training in overall health include increased strength, muscle tone, and bone density. This increase in strength, muscle tone, and bone density often translates into improved athletic performance such as improved speed and endurance. In addition, regular training has been shown to reduce the occurrence of cancer, diabetes, and cardiovascular diseases as well as improve immune system function, lower blood pressure, and alleviate symptoms of depression.

Resistance training is used in rehabilitation as well. For example, resistance training is often used to rebuild atrophied muscles and restore functionality of strained or injured joints. In some cases resistance training is even used as a part of cardiac rehabilitation as it is known that resistance training can improve cardiovascular health over time.

The muscles of the hip and thigh are used in walking, running, and almost every athletic activity. Thus, it is desirable to have a resistance training device configured to focus training on these muscles and their corresponding body structures. However, traditional training devices do not focus on the muscles of the hip and typically operate on both legs at the same time and thus are unsuitable in situations where training of one leg is desired such as in rehabilitation. In addition, traditional devices using weights do not provide variable resistance and thus are incapable of maximizing resistance across the range of motion of a user's legs.

Other traditional devices offer focused training for a single leg and may provide variable resistance; however, these devices are not focused on hip and thigh muscles and have very limited or no resistance adjustability.

Thus, what is desired and disclosed herein is a hip flexor for muscles of the lower extremities that provides variable and adjustable resistance while focusing training on a user's hip muscles.

SUMMARY OF THE INVENTION

A hip flexor comprising a frame, a hip actuator, and one or more resistance devices is disclosed. Generally, the hip flexor provides training and rehabilitation to a user by resisting a user's actuation of the actuator arm through one or more resistance devices. The frame generally has a top end, a bottom end, and one or more frame attachments. The hip actuator may comprise a downward extending actuator extension at the top end of the frame, an actuator arm comprising one or more actuator attachments, and a pivot attached to the actuator extension and the actuator arm. Generally, the pivot is configured to allow the actuator arm to swing about an axis. It is noted that the hip flexor may include more than one hip actuator at the top end of the frame in some embodiments. The one or more resistance devices are configured to provide resistance as the actuator arm is actuated. In some embodiments a pad may be attached to the actuator arm.

It is noted that the one or more resistance devices may comprise one or more springs. Also, the one or more resistance devices may be removably attached to the one or more frame attachments and to the one or more actuator attachments.

Portions of the hip flexor may be adjustable in one or more embodiments. For example, a hollow sleeve may be attached at the top end of the frame. The hollow sleeve may be configured to accept the actuator extension of the hip actuator and allow the hip actuator to be adjusted within the hollow sleeve. The adjustability of the hip flexor may be increased by including a collar configured to accept a horizontal member of the frame and move along the horizontal member of the frame. The collar has the hollow sleeve attached thereto in one or more embodiments. Moving the collar also moves the hip actuator which is adjustably secured within the hollow sleeve.

Other elements of the hip flexor may be adjustable as well. For example, the angle at which the one or more resistance devices meets the actuator arm may be adjustable. In addition, the pad may be adjustable along the length of the actuator arm.

In one embodiment, the hip flexor comprises a frame having a top and bottom end and one or more frame attachments, an actuator extension having one or more actuator attachments, an actuator arm, and one or more resistance devices attached to the one or more frame attachments and the one or more actuator attachments. As stated, the hip flexor generally provides training and rehabilitation to a user by resisting the motion of the actuator arm through one or more resistance devices. The actuator extension may be at the top end of the frame and extend downward. The actuator arm may be attached to the actuator extension by a pivot.

A hollow sleeve may be configured to accept the actuator extension therein to allow the actuator extension and the attached elements of the hip flexor to be adjusted in some embodiments. The hollow sleeve may be attached at the top end of the frame and may have at least one hole therein to accept a pin. In addition, the actuator extension may have one or more adjustment holes configured to accept the pin along its length. The actuator extension may then be secured at a desired position by inserting the pin into the at least one hole of the hollow sleeve and one of the one or more adjustment holes of the actuator extension.

The hip flexor of may comprise one or more track attachments, a first track, and a second track to allow the one or more resistance devices to be adjustable. The first track may be attached to the actuator arm and have at least one of the one or more track attachments thereon. The second track may be attached to the frame and have at least one of the one or more track attachments thereon. The one or more springs may then be attached to the actuator arm and the frame by the one or more track attachments. The resistance devices are thus adjustable because the one or more track attachments are adjustable along the first track and the second track.

A method of hip and thigh training is also disclosed. In one or more embodiments, the method comprises providing a hip actuator at a top end of a frame where the hip actuator extends downward and comprises an actuator extension and an actuator arm attached by a pivot. One or more resistance devices attached to the actuator arm by one or more actuator attachments and attached to the frame by one or more frame attachments provide resistance to motion of the actuator arm.

The method of one or more embodiments also comprises allowing a user to engage the actuator arm, and resisting the motion of the actuator arm as the actuator arm is moved to a second position by a force applied to the actuator arm by the user the actuator arm being in a first position. The user may engage the actuator arm with an anterior, interior, or exterior portion of a thigh.

In some embodiments, the method further comprises returning the actuator arm to its first position when the force applied by the user is less than the resistance provided by the one or more resistance devices. In addition, the resistance provided by the one or more resistance devices may be adjusted according to the method by adding, removing, or replacing the one or more resistance devices. The position of the one or more resistance devices and even the hip actuator may be adjusted as well.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Generally, the hip flexor is a training device configured to provide resistance training to the muscles and body structures of the lower extremities. Specifically, the hip flexor is designed to provide resistance training to hip and thigh muscles. Training these muscles is beneficial to other nearby muscles as well, including the gluteus maximus and quadriceps as well as thigh, leg, ankle, and foot muscles.

It is specifically intended that one or more embodiments of the invention may be used to train muscles of the iliopsoas. These muscles are heavily used during running and their training has the benefit of increased running speed and agility. As will be described further below, the muscles of the iliopsoas may be trained by actuating the hip flexor through a motion similar to a running stride.

In addition, training of the hip area of the body has the beneficial effect of training other areas of the body. For example, abdominal and arm muscles used to stabilize a user during training on the hip flexor also undergo training. The hip flexor, in one or more embodiments, may also be configured to provide resistance training to one side of the user's body at a time. Thus, the device is well suited for rehabilitation as well as training because a user may selectively train each or both sides of his or her body.

Figure 1:
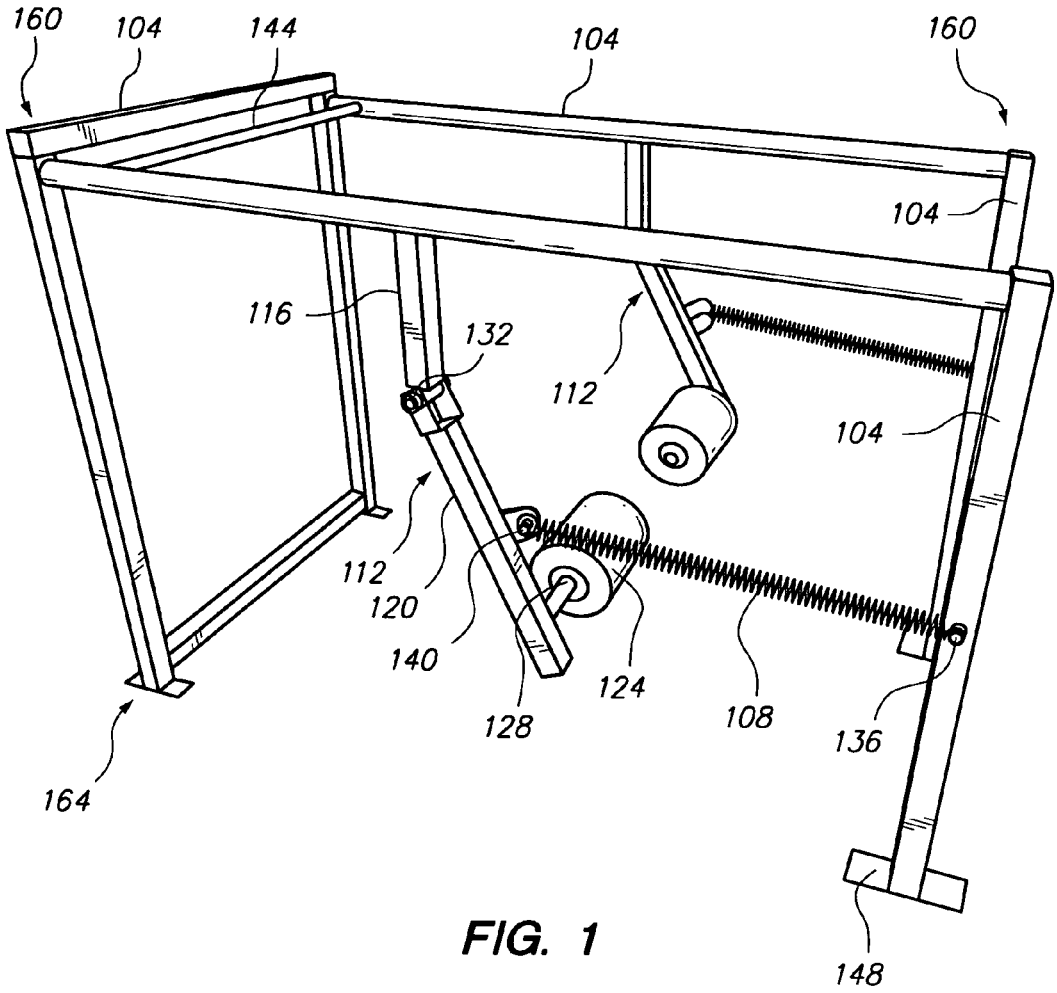
FIG. 1 illustrates a perspective view of an embodiment of the invention.

Referring to FIG. 1, the hip flexor in one or more embodiments includes a frame 104 with a base 148. Generally, the frame 104 provides a structure upon which the base 148, and other elements of the hip flexor may be attached. The frame 104 has a top end 160 and a bottom end 164. As illustrated, the hip flexor's frame 104 and other elements comprise one or more tubes or bars having square or rectangular cross sections. However, it is noted that in one or more embodiments, elements of the hip flexor's underlying structure may have cross sections of different shapes and it is contemplated that these cross sections are not required to be closed shapes. For example, the cross sections may be circular, hexagonal, or other closed shape. In addition, the cross sections may be I shaped (similar to an I-beam), C shaped, or another open shape.

Of course, various configurations are possible, and thus it is contemplated than any frame 104 capable of supporting the elements of the hip flexor such that they operate according to the description herein may be used. For example, the frame 104 may be square or rounded in shape. In addition, the frame 104 may have fewer or additional horizontal members extending from various points along its vertical length, or the frame may include diagonal members in one or more embodiments. It is contemplated that the frame is formed from rigid materials such as but not limited to steel, aluminum, carbon fiber, or one or more other metals or alloys.

The base 148 in one or more embodiments is a generally planar rigid structure that may be formed from similar materials as the frame. The base 148 ensures that the frame 104 remains stationary and stable when the hip flexor is both in use and not in use. In some embodiments, the base 148 may be secured to the floor so as to provide additional support such as to resist tipping. In other embodiments, the base 148 may be sufficiently large such that the hip flexor remains stationary and stable without being secured to the floor. The base 148 may be a single continuous structure or may be individual structures such as shown in FIG. 1. It is contemplated that a base 148 may not be necessary in all embodiments, as the hip flexor may be secured to one or more walls. The hip flexor may be secured with various fasteners such as but not limited to screws, brackets, nuts and bolts, or a combination thereof. In some embodiments, the frame 104 may be configured such that it is stationary and stable without a base 148.

Attached to the frame 104 is a hip actuator 112 which engages a user's thigh to provide resistance training to the user's hip and thigh. Though described below as being engaged by a user's thigh, it is noted that the hip actuator 112 may be engaged by other portions of a user's leg including but not limited to the user's hip, thigh, and lower and upper leg. In one or more embodiments, the hip actuator 112 comprises an actuator extension 116 and an actuator arm 120 connected by a pivot 132. As will be described further below, during training, a user actuates the actuator arm 120 about the pivot 132 by engaging the actuator arm 120 with his or her thigh. It is noted that the actuator arm 120 may be actuated through one or more pads 124 attached to the actuator arm 120 in one or more embodiments.

More than one hip actuator 112 may be attached to a single frame 104 in some embodiments such as shown in FIG. 1. The hip actuators 112 may be attached to a frame 104 such that each hip actuator is positioned to engage each side of the user. In these embodiments, a user may train either side of his or her body without reconfiguring the hip actuator 112 or reorienting his or her body. In addition, a user may rapidly alternate between training the left and right sides of his or her body. Of course, only one hip actuator 112 may be provided in some embodiments.

Generally, the one or more pads 124 comprise one or more padded structures which allow a user's thigh to comfortably engage the hip actuator 112. In one embodiment, the pad 124 is cylindrical in shape; however other shapes may be used. In addition, the pad 124 may be configured to rotate as the hip actuator 112 is actuated. For example, the pad 124 may roll up or down a user's hip as it is actuated. It is noted that any pad 124 may be used with the invention herein.

In one embodiment, the actuator extension 116 and the actuator arm 120 are attached at their proximal ends by a pivot 132. Generally, the pivot 132 allows the actuator arm 120 to rotate or swing along a vertical axis as it is actuated. The pivot 132 may be a hinge or similar structure where either end of the structure is free to rotate along an axis. For example, the pivot 132 may comprise a first end and a second end, the proximal end of each having a hole for a rod or pin therethrough. In this manner, the first and second ends of the pivot 132 rotate around the pin along an axis. One end of the pivot 132 may then be attached to the actuator extension 116 while the other end of the pivot is attached to the actuator arm 120. It is noted that any pivot or hinge that allows the actuator arm 120 to pivot along at least one axis, now known or later developed, may be used with the invention herein.

In one or more embodiments, the hip actuator 112 extends downward. To illustrate, the actuator extension 116 may be attached at the top end 160 of the frame such that the pivot 132 and the actuator arm 120 are below the actuator extension 116. In this manner, the actuator arm 120 may rotate about the pivot 132 below the actuator extension 116. Though FIG. 1 illustrates the actuator extension 116 as perpendicular from frame's 104 structure at the top end 160, it is noted that the actuator extension 116 may extend downward at various angles. In addition, some embodiments, may not require an actuator extension 116 as the pivot 132 of the hip actuator 112 may be directly attached to the frame 104.

The hip flexor generally provides training by resisting the movement of its user. In one or more embodiments, one or more springs 108 may be used as resistance. Note that, though the resistance herein is generally described as provided by a spring 108, it is contemplated that other resistance devices, such as elastic bands or elastic tubing, may be used alone or in combination with the springs 108 to provide resistance. For example, one or more elastic bands or elastic tubing may be used alone in combination with the springs 108 in some embodiments. The elastic bands may be configured to attach to the hip flexor in a similar manner as the springs 108.

A spring 108 is advantageous because it may provide variable resistance in one or more embodiments. An individual's strength is not constant but rather varies along a strength curve. For example, the strength of a muscle may increase during flexion. It is also known that a resistance may be more or less easily moved by a fulcrum and lever depending on its position with respect the lever's fulcrum or pivot point. The body's skeletal structure contains many fulcrum and lever structures. For example, a person's legs pivot along at one or more joints. Thus, resistance training with a fixed resistance is less effective than training with variable resistance because a fixed resistance does not increase with the body's strength curve.

In contrast, a variable resistance, in one or more embodiments, may increase with the body's strength curve. In this manner, training is more effective because a muscle must work against a resistance that increases as the muscle moves from its weakest to strongest position. A fixed resistance is limited, in that, the amount of resistance is generally the amount the body can move at its weakest points. Therefore, it can be seen that while fixed resistance may be sufficient for training the body at its weakest point, a lesser amount of training is achieved for the muscles used when the body is at stronger points.

A spring 108 may be selected to correspond to the strength curve of the muscles of a particular user in one or more embodiments. For example, the size and number of coils, or the thickness, rigidity, or both of the materials used to form a spring 108 may be varied across the length of the spring. In this manner the spring 108 may be configured to provide more or less resistance as it is stretched. It is contemplated, that one or more fixed resistance devices, such as weights, may be used in addition to one or more variable resistance devices to increase resistance, if desired.

Generally, a spring 108 has two ends and is attached at one end to an actuator attachment 140 on the actuator arm 120 and at the other end to a frame attachment 136 on the frame 104. The actuator attachment 140 and the frame attachment 136 may allow the spring 108 to be attached permanently. For example, the attachments may be welds or rivets which hold the spring 108 to the actuator arm 120 and frame 104. It is contemplated that any one or more fasteners or structures, now known or later developed, capable of permanently securing the spring 108 to the actuator arm 120 and the frame 104 may be used as well.

Figure 2:
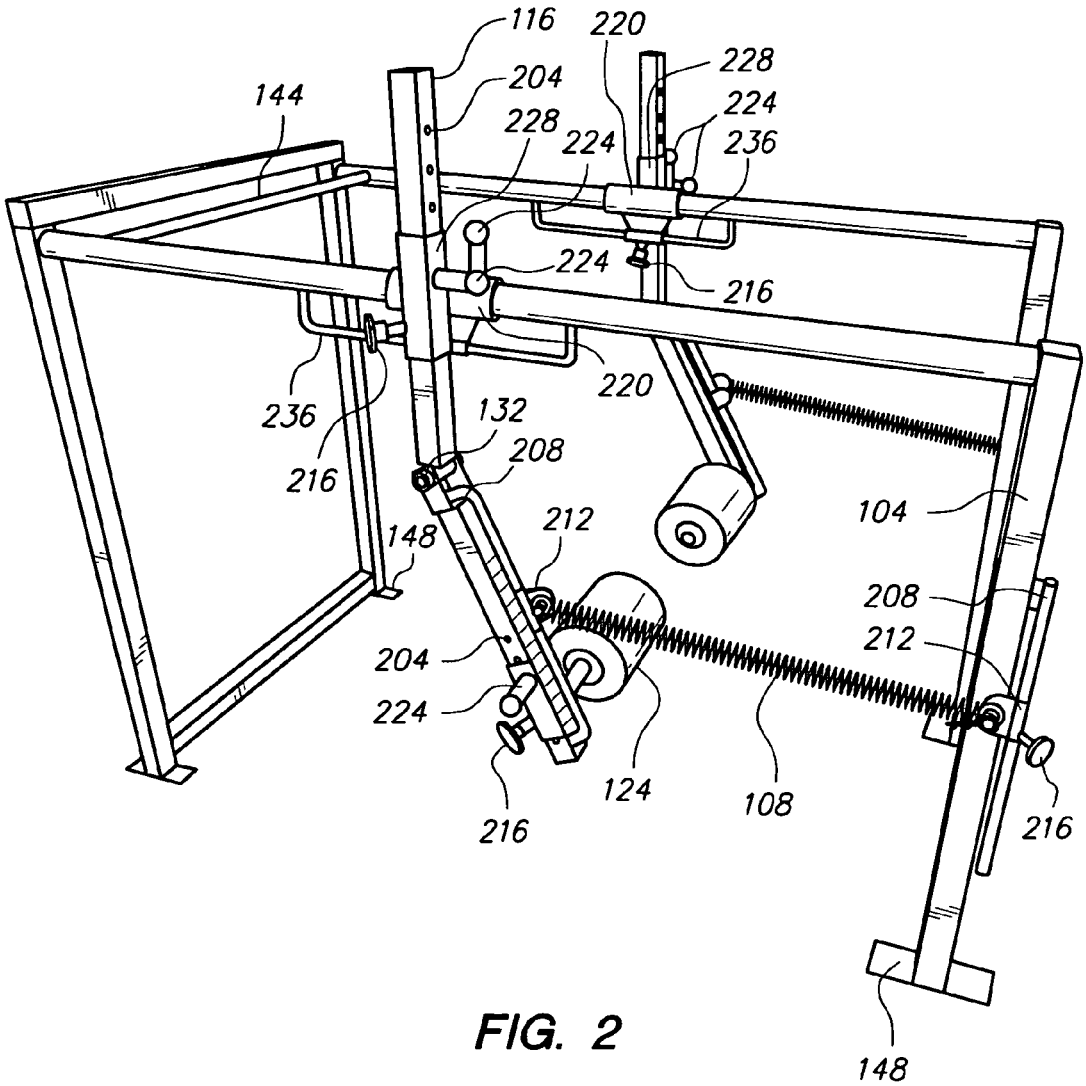
FIG. 2 illustrates a perspective view of an adjustable embodiment of the invention.
Figure 3:
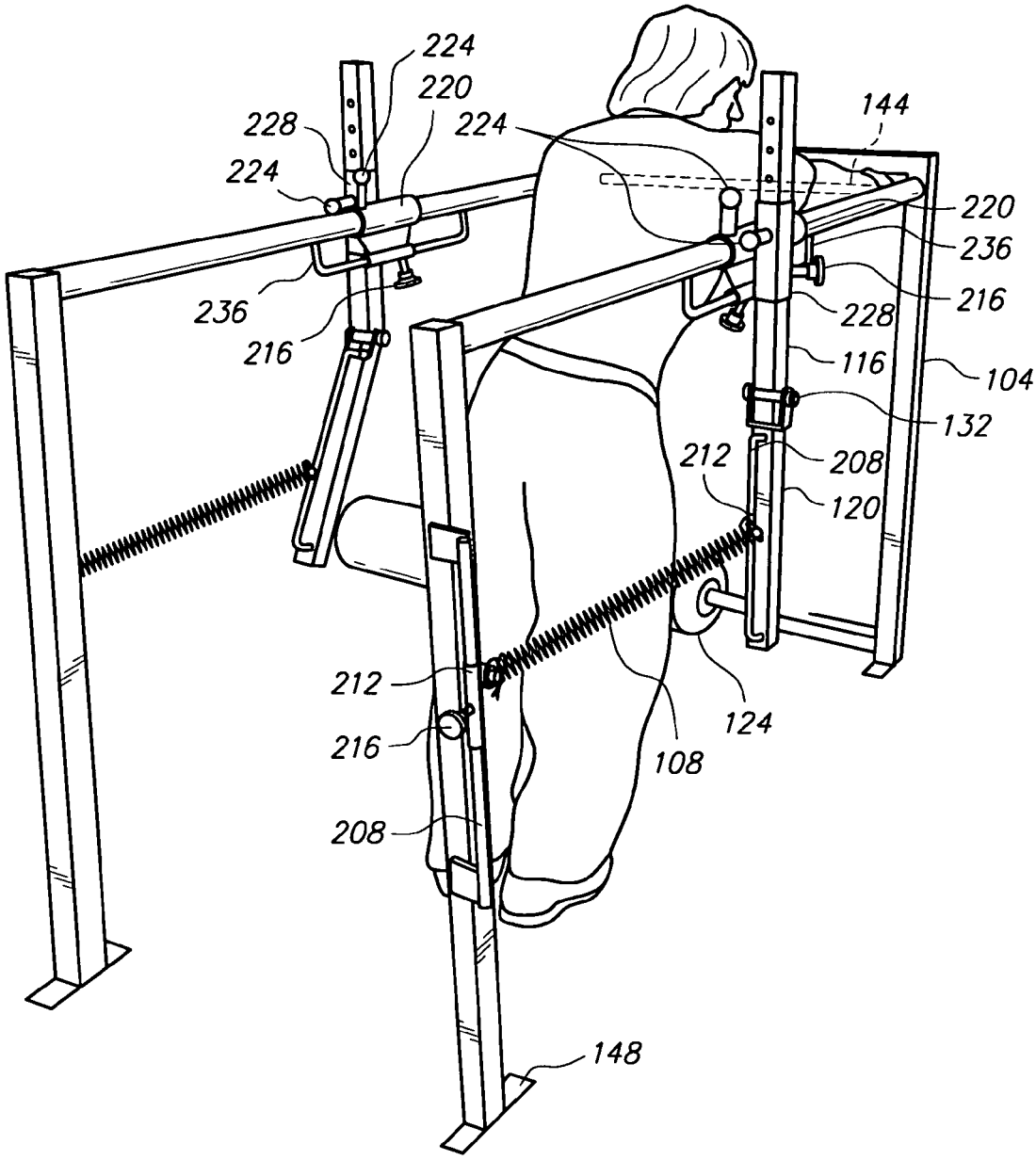
FIGS. 3-4 illustrate a user training the anterior and posterior thigh muscles according to an embodiment of the invention.

In some embodiments, the spring 108 may be removably attached. This allows a spring 108 to be removed and replaced for maintenance or to adjust the resistance provided by the hip flexor. Removable attachment may be accomplished in various ways. For example, one or more screws, nuts, bolts, pins, clips, clamps, hooks, loops, or a combination thereof may be used. In one embodiment, both ends of the spring 108 have a hook which engages a frame attachment 136 and an actuator attachment 140 comprising a rod such as illustrated in FIG. 1. In other embodiments, either or both ends of the spring 108 may have a hole, hook, or eyelet, or loop to allow a screw, bolt, pin, or other removable fastener to be inserted therethrough. If the frame attachment 136 or actuator attachment 140 comprise a rod or pin, a retaining clip may be provided, such as illustrated in FIGS. 2 and 3, to prevent the spring 108 from sliding off the rod or pin. In other embodiments, the spring's 108 hole or loop may engage a frame attachment 136 or an actuator attachment 140 comprising a hook to allow the spring 108 to be removably attached. It is contemplated that any one or more fasteners or structures capable of removably securing the spring 108 to the actuator arm 120 and the frame 104 may be used.

It is contemplated that a plurality of springs 108 may be attached in one or more embodiments. In these embodiments, multiple actuator attachments 140, frame attachments 136, or both may be provided, or the actuator and frame attachments may be configured to allow multiple springs 108 to be attached thereto. The plurality of springs may be permanently or removably attached as described above.

In one or more embodiments the hip flexor may be configured with one or more hand holds 144. A hand hold 144 may be used to stabilize a user as he or she exercises. However, a hand hold 144 is also advantageous where the hip flexor is used for rehabilitation. Users undergoing rehabilitation may have difficulty standing and thus a hand hold 144 may be provided to allow these users to stabilize themselves while utilizing the hip flexor.

The one or more hand holds 144 may also be employed to enhance training, if desired. For example, some manner of upper extremity training is realized when a user is using upper body strength to stabilize his or her body during training. In addition, a user may use the hand holds 144 to resist upward movement as the user actuates the hip flexor.

The one or more hand holds 144 may be configured in various ways. In FIG. 1, a hand hold is shown as a bar which the user may grasp. Of course, as shown in FIGS. 5-8, the user may grasp portions of the frame 104 as a hand hold as well. It is contemplated that multiple hand holds 144 may be present in one or more embodiments.

In one or more embodiments, the hip flexor may be adjustable. In these embodiments, the position of the hip flexor's elements or the amount of resistance provided by the hip flexor may be adjusted. FIG. 2 illustrates an embodiment of a hip flexor configured to be adjustable. In this embodiment, both the position of the hip actuator 112 and the amount and type of resistance provided by the hip flexor is adjustable.

Adjustment is advantageous in that it allows the hip flexor to fit users of various sizes and strength. For example, the hip actuator 112 may be raised or lowered or moved horizontally depending on the height, length of the user's limbs, or other characteristic of the user's body. The resistance may also be raised, lowered, or otherwise adjusted to meet the training goals of the user, according to the user's strength, or a combination of both. It is contemplated that the position or resistance of hip flexor may also be adjusted for the comfort of the user, to ensure the hip flexor is being used properly, to ensure safe use of the hip flexor, according to the desires of its users, or a combination thereof.

As shown, the hip actuator 112 is held to the frame by a hollow sleeve 228 configured to accept the hip actuator's 112 actuator extension 116 therethrough. In one embodiment, the sleeve 228 is a tubular structure large enough to accept the actuator extension 116. Though shown as a square tube, the sleeve 228 may have various shapes and may correspond to the actuator extension's 116 cross-section in one or more embodiments.

In addition, the sleeve 228 may include a hole in at least one of its sides configured to accept a pin 224 or other fastener. A series of adjustment holes 204 may be formed along the length of the actuator extension 116. The position of the hip actuator 112 may be adjusted by sliding the hip actuator's 112 actuator extension 116 within the sleeve 228 and securing the actuator extension 116 with one or more pins 224 once it is positioned as desired.

Generally, the actuator extension 116 is secured by inserting the pin 224 through the hole in the sleeve 228 and into an adjustment hole 204 on the actuator extension 116. However, it is noted that the adjustment holes 204 are not required and thus may not be present in all embodiments. For example, the sleeve 228 may be configured with a threaded hole to accept a threaded pin. In this embodiment, the threaded pin may be screwed into the sleeve 228 and tightened against the actuator extension 116 to secure the actuator extension within the sleeve. Of course, the actuator extension 116 may be secured within the sleeve in various ways. It is noted that any fastener or structure capable of securing the actuator extension 116, including but not limited to clamps, screws, clips, nuts, bolts, or a combination thereof, now known or later developed, may be used.

The embodiment illustrated in FIG. 2 utilizes both a pin 224 and a threaded pin 216 to secure the actuator extension 116 within the sleeve. As shown in FIG. 2, the sleeve 228 has a threaded pin 216 and a pin 224 inserted therein. In this embodiment, the pin 224 may be inserted into a hole in the sleeve 228 and into an adjustment hole 204 of the actuator extension 116. The threaded pin 216 may be screwed into a threaded hole in the sleeve 228 to further secure the actuator extension 116 in place.

In one or more embodiments, the hip actuator 112 may be adjustable horizontally along the frame 104. For example, the sleeve 228 may include a collar 220 configured to accept a horizontal member of the frame 104 therethrough. Though shown as slidably adjustable in FIG. 2, it is noted that the sleeve 228 may also be integrally formed into or directly attached to the frame such as by one or more welds or screws. In these embodiments, a collar 220 is not required.

The collar 220 generally allows the sleeve 228 to slide or move along a member of the frame 104 and be secured when positioned as desired. The collar 220 may be secured in place by one or more pins 224 inserted into one or more holes in the collar, one or more adjustment holes on a horizontal member of the frame, or both, as described above. Though the collar 220 has been illustrated as secured by a pin 224, it is noted that a threaded pin 216 may be screwed into a threaded hole of the collar, a member of the frame, or both to secure the collar in place. Other fasteners or structures now known or later developed may also be used to secure the collar 220 as well. It is contemplated that the sleeve 228 may be directly attached at the top end of the frame 104 at any point by one or more screws, nuts, bolts, clips, or clamps without the need for a collar 220 in some embodiments.

It is also noted, that the hip actuator 112 may be adjustable without the need for a sleeve 228, collar 220, or either in some embodiments. The hip actuator's 112 actuator extension 116 may be positioned as desired and then directly attached to the frame 104 by one or more pins 224, threaded pins 216, or by any other fastener, including but not limited to screws, nuts, bolts, or a combination thereof, now known or later developed. In addition various structures now know or later developed may be used. For example, the actuator arm may be secured by a quick release clamping system such as the quick release clamping systems often found on bicycles. Generally, such systems operate by providing a hollow guide having an opening to accept an adjustable element. When the adjustable element is in the desired position, the opening of the hollow guide is tightened which clamps the adjustable element in place. Other clamping structures as well as various clips may be used as well.

As stated, the amount of resistance may be adjusted by replacing the spring 108; however, the amount of resistance may also be adjusted by positioning the spring to increase or decrease the amount of tension on the spring. Generally, when then ends of the spring 108 are held further apart, such as by adjustment of the actuator arm 120 or the actuator extension 116, resistance is higher.

The variability of the resistance may be adjusted as well. For example, the variability of the resistance may be changed by adjusting the angle at which the spring 108 meets the actuator arm 120. At different angles, the amount of resistance the user experiences varies as the hip actuator 112 is actuated. For example, at one angle, the resistance may increase more quickly as the hip actuator 112 is actuated than if the spring 108 is at another angle. This is advantageous in training and rehabilitation, as the resistance may be finely tuned to the needs of a particular user.

In particular, a spring 108 positioned such that it is substantially perpendicular to the actuator arm 120 when the actuator arm is in its unactuated position, may provide increased resistance at the beginning of every actuation. In other positions, the spring 108 may provide increased or decreased resistance at one or more other points as the actuator arm 120 is actuated.

In one or more embodiments, the position of the spring 108 may be adjustable at both its ends. Of course, some embodiments may only allow adjustment at one end. In FIG. 2, adjustment is accomplished through a hollow tubular track attachment 212 which accepts a track 208 therethrough and moves or slides along the track. The track attachment 212 may have a threaded hole in one or more of its sides to accept a threaded pin 216. The spring 108 may attach to one or more track attachments 212 permanently or removably in the manner described above with regard to the frame attachment and the actuator attachment. To position an end of the spring 108, the track attachment 212 is moved along the track 208 until it reaches the desired position or height. The track attachment 212 may then be secured in place by threading a threaded pin 216 through the threaded hole and tightening the threaded pin onto the track 208. A track 208 may be attached to the frame 104, the actuator arm 120, or both to allow adjustability of either or both ends of a spring 108 as desired. It is noted that attachment may occur in any other manner now known or later developed as well.

The embodiment shown in FIG. 2 has a track 208 on the frame 104 and a track on the actuator arm 120. It can thus be seen that a wide variety of spring positions may be achieved by adjusting the track attachment 212 along either or both tracks 208. Of course, an embodiment with a single track 208 also provides adjustability.

A spring 108 may be adjustable without a track 208 in some embodiments. For example, the frame attachment 136, the actuator attachment 140, or both may be removably attached at various points along the frame 104 or the actuator arm 120, respectively. For example, the frame 104, or actuator arm 120 may have a series of holes allowing the frame attachment 136 or the actuator attachment 140 to be attached by one or more screws or threaded or unthreaded pins. In addition, as stated above, multiple frame attachments 136, actuator attachments or both may be provided to allow one or more springs 108 to be attached at various locations.

It is noted that the collar 220 described above may be similarly secured in place by a collar track 236 and a threaded pin 216. As shown in FIG. 2, a portion of the collar 220 may include a hollow tubular structure which accepts the collar track 236 therethrough and is movable along the collar track. Once the hip actuator 112 and its attached collar 220 are positioned as desired, a threaded pin 216 may be tightened onto the collar track to secure the collar and thus the hip actuator in place.

Adjustability of the spring's position may be accomplished through other structures or fasteners as well. It is contemplated that any fastener or structure capable of allowing the position of either or both ends of the spring 108 to be adjusted may be used with the invention. For example, multiple actuator attachments, frame attachments, clips, clams, screws, nuts, bolts, or a combination thereof may be provided to allow a spring to be attached at various locations on the actuator arm 120 or the frame 104.

Other elements of the hip flexor may be adjustable as well. As shown in FIG. 2, the pad 124 is adjustable along the length of the actuator arm 120. This may be accomplished in a variety of ways as well. For example, the pad 124 may be secured by various fasteners or structures including but not limited to clamps, screws, clips, nuts, bolts, pins, or a combination thereof, now know or later developed. It is noted that any fastener or structure capable of securing a pad 124 to the actuator arm 120 may be used.

The pad 124 of the embodiment in FIG. 2 is adjustable through a series of adjustment holes 204 formed along the length of the actuator arm 120. In this embodiment, the pad 124 has a C shaped guide configured to accept the actuator arm 120. The guide allows the pad 124 to slide or move along the length of the actuator arm 120 and has a hole on at least one of its sides. The pad 124 may then be adjusted by aligning the guide's hole with an adjustment hole 204, and securing the guide in place by one or more pins 224. In some embodiments, the guide's hole may be threaded to allow for screws or other threaded pins 216 to be used. The adjustment holes 204 may be threaded as well. As shown in FIG. 2, the pad's guide may accept both a pin 224 and a threaded pin 216 to secure the pad to the actuator arm 120. In some embodiments, the pad 124 may be removed from the actuator arm 120, positioned at a point along the actuator arm, and secured in place by one or more screws, pins 224, or threaded pins 216 without the need for a guide.

It is noted that adjusting the pad 124 may also adjust the resistance experienced by a user. For example, the pad's 124 position relative to the angle of the spring 108 may change the amount and type of resistance as explained above. It is contemplated that the adjustability of the hip flexor may vary from embodiment to embodiment. For example, some embodiments may include at least one adjustable element or all the adjustable elements described herein, while other embodiments may have no adjustable elements.

Training with the hip flexor will now be described referring to FIGS. 3-8. The hip flexor allows a variety of hip and thigh exercises and rehabilitation to be performed. Generally, a user may utilize the hip flexor by performing one or more repetitions of particular hip and thigh motions on the actuator arm 120. The actuator arm 120 provides resistance against the user's motion through its attached spring 108. This resistance provides the training or rehabilitation of the hip and thigh muscles because the muscles work against and overcome the resistance to actuate the actuator arm 120. In addition, the repetitions of the hip and thigh motions may also be used to train or rehabilitate joints, tendons, and other body structures of the hip and thigh. For example, articulation of the hip joint may be improved through regular training on the hip flexor.

Figure 4:
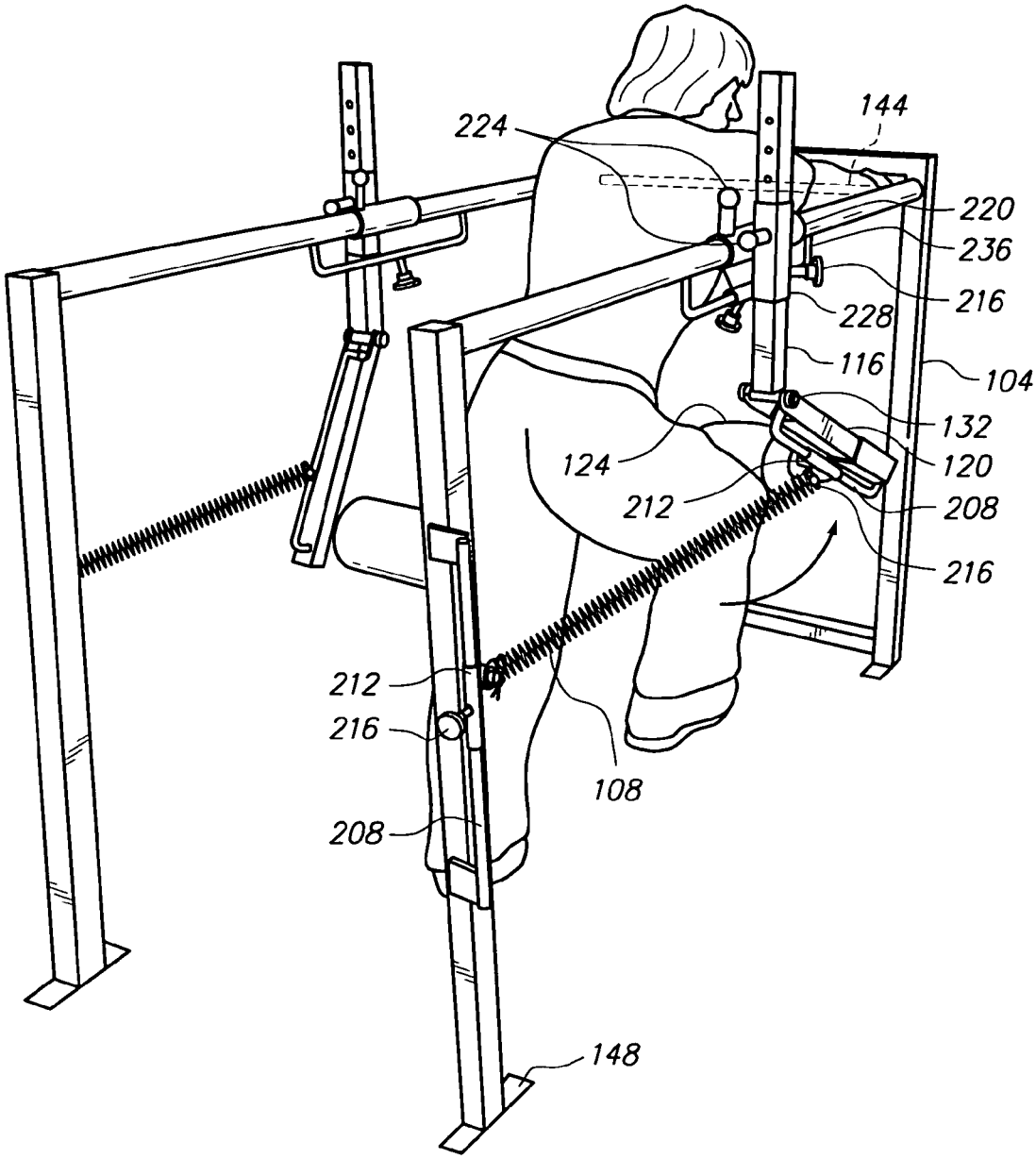

FIGS. 3-4 show a user training the anterior and posterior muscles of the thigh such as but not limited to, the quadriceps and hamstring muscles respectively. In FIG. 3, the user engages the pad 124 of the actuator arm 120 with the front of his or her thigh while grasping the hand hold 144. Of course, grasping the hand hold 144 is not always required, and the pad 124 may not be provided in all embodiments. Where there is no pad 124, a user may directly engage the hip actuator 112 through the actuator arm 120.

The user may actuate the actuator arm 120 along an arc about its pivot 132 by moving his or her thigh in an upward and forward motion as shown in FIG. 4. The actuation of the actuator arm 120 stretches the spring 108 which provides resistance against the user's motion. The actuator arm 120 may be actuated as far as desired or to a certain extent, such as if the actuator arm is configured to stop at a certain point.

The user may then reduce the force on the actuator arm 120 to allow the spring 108 to return the actuator arm back to its original or unactuated position. Some force against the return motion of the actuator arm 120 may be applied by the user as the actuator arm returns to its original position. In this manner, training of the hip and thigh also occurs as the actuator arm 120 returns.

It is noted that the iliopsoas muscles may be trained in a similar manner. When the user actuates the actuator arm 120 along an arc about its pivot 132 by moving his or her thigh in an upward and forward motion as shown in FIG. 4, the muscles of the iliopsoas are used and thus undergo training. It can be seen that the motion of the users hip, thigh, and leg is similar to that of a running stride and thus training on the hip flexor in this manner is beneficial to a user's running speed. Also, the user's upward and forward motion trains the same iliopsoas (and other) muscles used to lift a user's leg during running. Running speed is increased, in part, by the strengthening of these muscles because a runner's legs may be lifted faster for each running stride.

Figure 5:
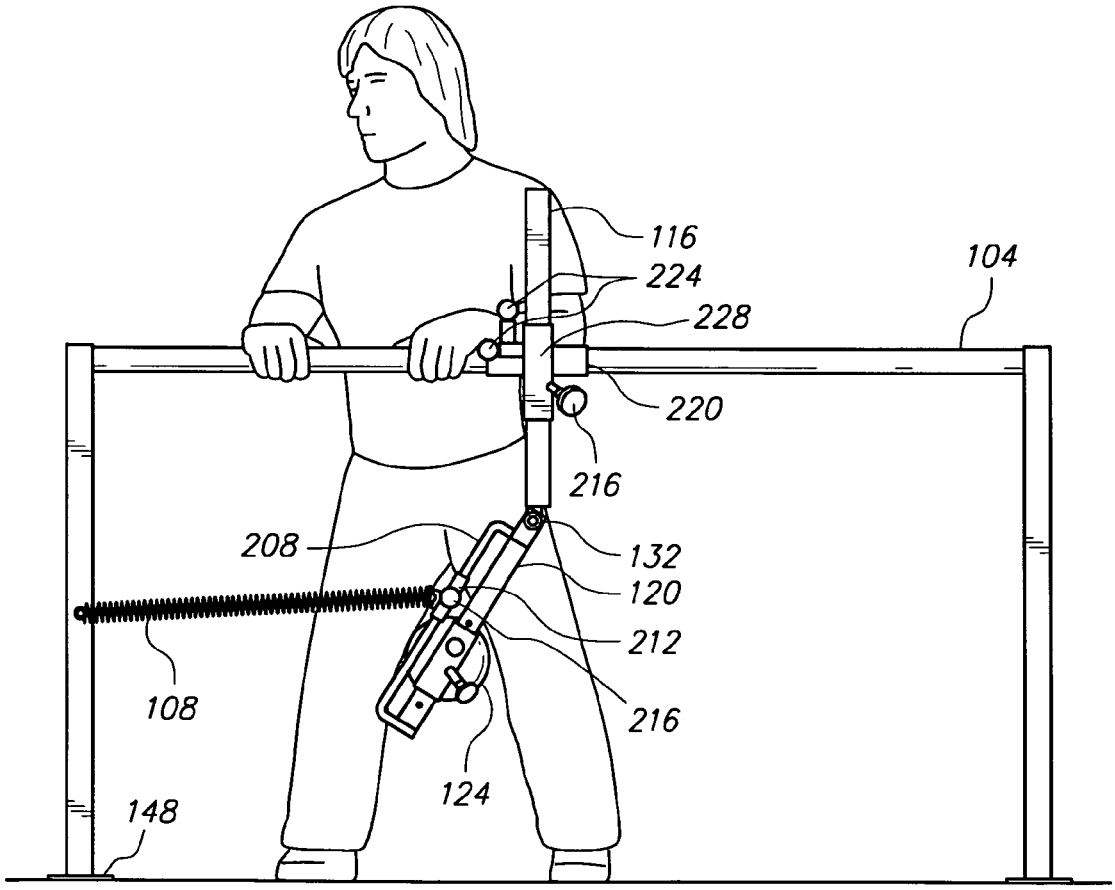
FIGS. 5-6 illustrate a user training the adductor muscles of the thigh according to an embodiment of the invention.
Figure 6:
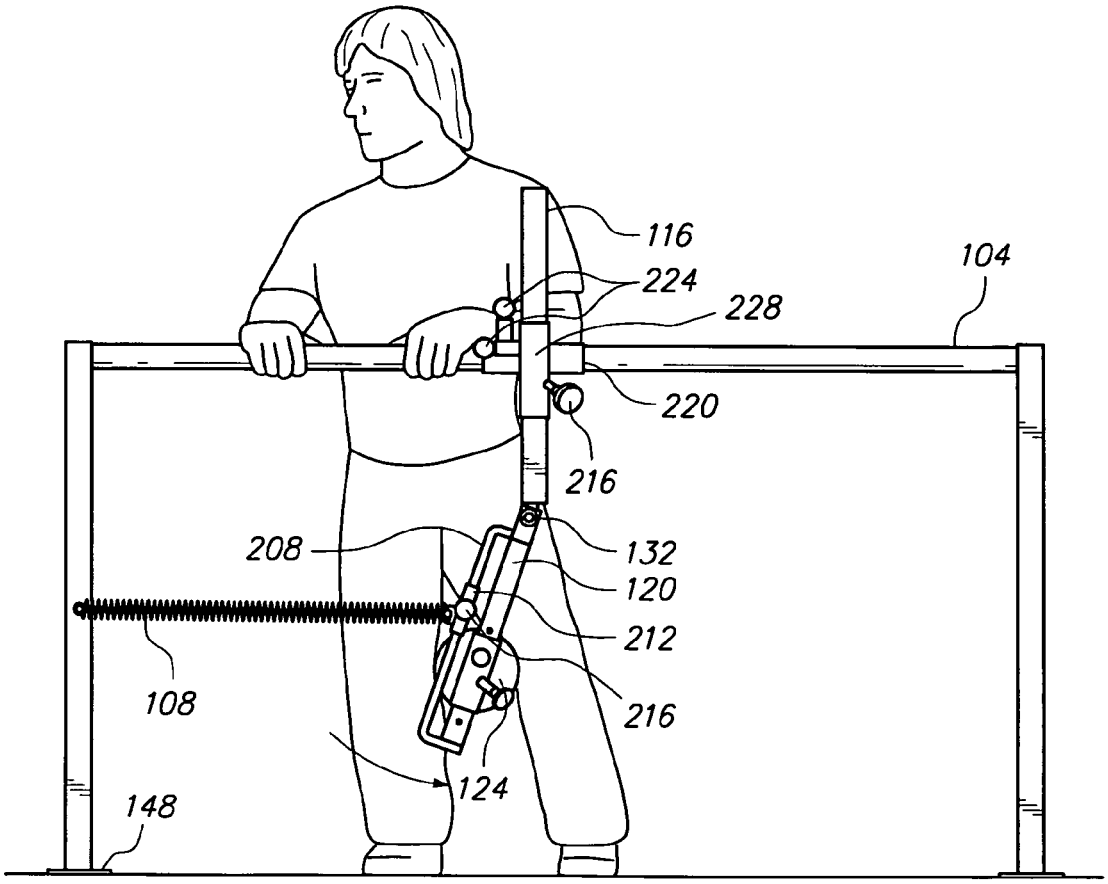

FIGS. 5-6 show a user training the adductor muscles on the interior of the thigh. In FIG. 5, the user engages the pad 124 of the actuator arm 120 with the interior of his or her thigh while grasping the frame 104 of the hip flexor. Of course, the user may or may not grasp the frame 104 or a hand hold as desired. The user may then actuate the actuator arm 120 against the resistance of the spring 108 by moving the thigh engaged to the pad 124 inward. The user may actuate the actuator arm 120, as shown in FIG. 6, and then reduce the force he or she is applying to allow the spring 108 to return the actuator arm 120 to its original position. Thus, the adductor muscles also undergo training during the actuation and return of the actuator arm 120.

Figure 7:
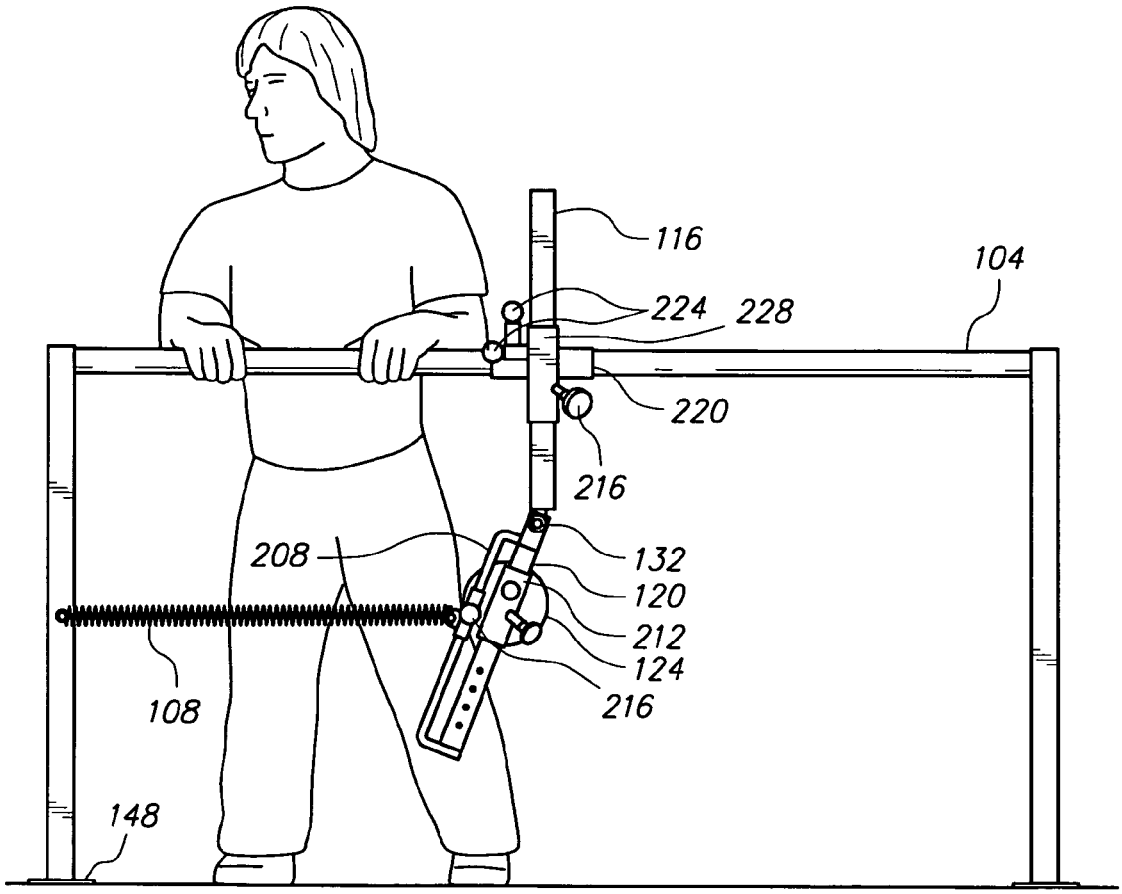
FIGS. 7-8 illustrate a user training the abductor muscles of the thigh according to an embodiment of the invention.
Figure 8:
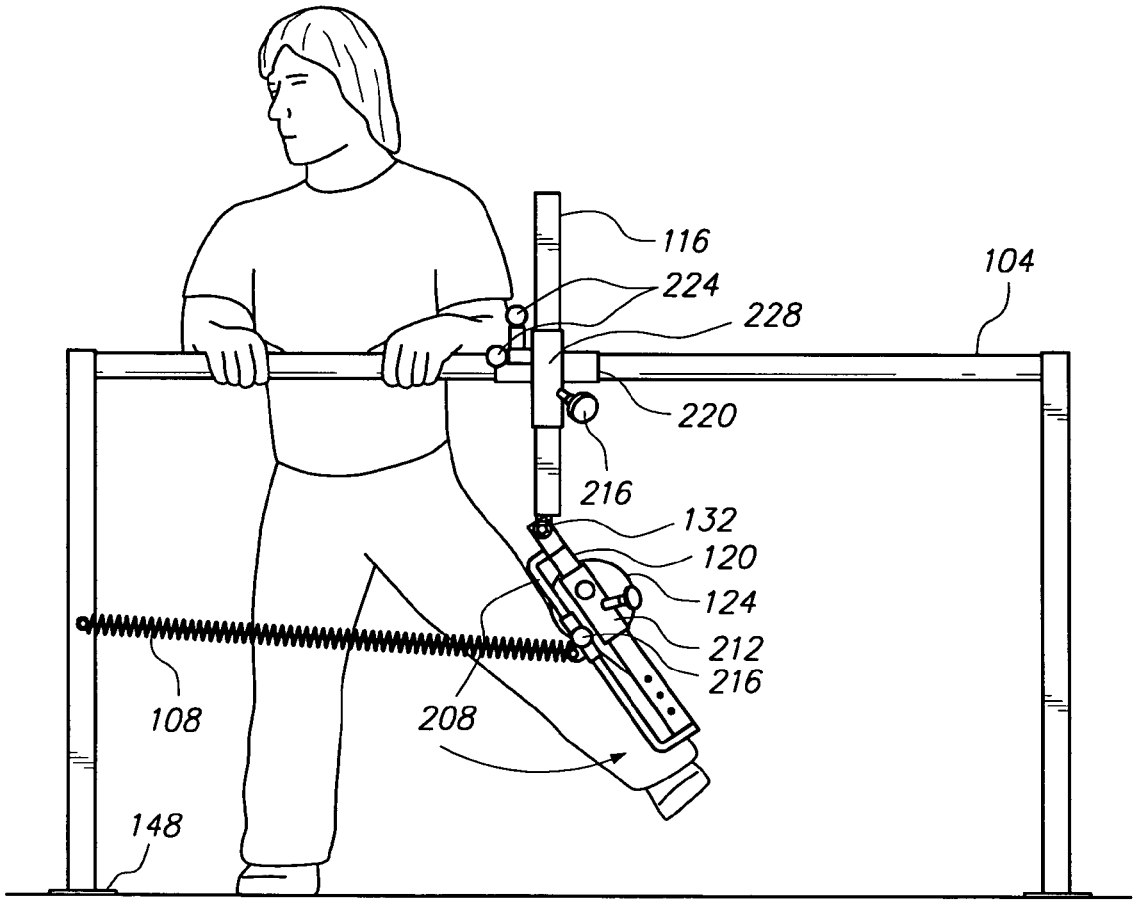

FIGS. 7-8 show a user training the abductor muscles on the exterior of the thigh. It is noted that these muscles may include muscles of the quadriceps and hamstrings. FIG. 7 shows a user laterally engaging the pad 124 of the actuator arm with the exterior of his or her thigh while grasping the frame 104 of the hip flexor. It is noted that grasping the frame 104 or a hand hold is not required in all circumstances. The user may then actuate the actuator arm 120 by moving the thigh engaged to the pad 124 outward as shown in FIG. 7. The spring 108 provides resistance and thus training during the outward motion. The user may resist the return motion of the actuator arm 120 to further train his or her muscles as the spring 108 returns the actuator arm to its original position.

As discussed above, the hip flexor may be adjusted to fit users of various sizes. In addition, the hip flexor may be adjusted to suit different types of training such as those discussed above. For example, the hip actuator 112 may be raised or lowered or moved horizontally to a user to properly engage the hip actuator during training. It is contemplated that different types of training, such as those described with regard to FIGS. 3-8, may require that the hip flexor be adjusted. Generally this adjustment will include adjusting the elements of the hip actuator such that the user may engage the hip actuator with his or her body at the proper location or position. For example, when performing the training as illustrated in FIGS. 3-4, the hip actuator 112 may be positioned such that the user engages the actuator arm 120 slightly above his or her knee. This adjustability is advantageous in that it helps to ensure safe use of the hip flexor and comfort of the user so that the user continues to train.

Thus, adjusting the hip flexor may be included in some embodiments of the method of training. For example, a user may adjust the position of the actuator arm 120 such as by raising or lowering it. A user may also adjust the amount or variability of the resistance the hip flexor provides such as by replacing one or more springs 108 or by adjusting the angle at which the spring 108 or springs meet the actuator arm 120. As stated, such adjustments may be made according to the user's physical characteristics, such as height or strength, or a training or rehabilitation program.

It is noted that most if not all of the training performed on the hip flexor, such as the training described above, will involve movement of the hip joint and its associated muscles. Thus, the muscles of the hip also undergo training, rehabilitation, or both when a user is utilizing the hip flexor. It is also noted that while training has been generally described above referring to certain muscles, surrounding muscles may also undergo some degree of training. In addition, muscles in other areas of the body, such as the lower leg, feet, torso, back, hand, or arms, undergo training as well. For example, surrounding muscles or muscles in other areas of the body, such as back muscles or abdominal muscles, may undergo training as they are used to stabilize, balance, or hold a user in place during training. Also, in one or more embodiments, the hip flexor engages one leg at a time, and thus the other leg may undergo some amount of training as it is used to stabilize and hold the user in place.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A hip flexor comprising:

a frame comprising a top end, a bottom end, and one or more frame attachments;

a hip actuator, the hip actuator comprising:

an actuator extension at the top end of the frame, the actuator extension extending downward;

an actuator arm comprising one or more actuator attachments thereon; and a pivot attached to the actuator extension and the actuator arm, the pivot configured to allow the actuator arm to swing about an axis;

one or more resistance devices attached to the one or more frame attachments and to the one or more actuator attachments, the one or more resistance devices configured to provide resistance as the actuator arm swings about the axis; and a hollow sleeve attached at the top end of the frame configured to accept the actuator extension of the hip actuator, wherein the hip actuator is adjustable within the hollow sleeve.

2. The hip flexor of claim 1 wherein the one or more resistance devices comprise one or more springs.

3. The hip flexor of claim 1 wherein the one or more resistance devices are removably attached to the one or more frame attachments and to the one or more actuator attachments.

4. The hip flexor of claim 1 further comprising a pad attached to the actuator arm.

5. The hip flexor of claim 1 further comprising a collar configured to accept a horizontal member of the frame and move along the horizontal member of the frame, the collar having the hollow sleeve attached thereto.

6. The hip flexor of claim 1 wherein the angle at which the one or more resistance devices meets the actuator arm is adjustable.

7. The hip flexor of claim 1 wherein the pad is adjustable along the length of the actuator arm.

8. The hip flexor of claim 1 further comprising at least one additional hip actuator at the top end of the frame.

9. A hip flexor comprising:

a frame comprising a top end, a bottom end, and one or more frame attachments;

an actuator extension at the top end of the frame, the actuator extension extending downward;

an actuator arm attached to the actuator extension by a pivot, the actuator arm comprising one or more actuator attachments;

one or more resistance devices attached to the one or more frame attachments and the one or more actuator attachments, wherein the one or more resistance devices resist motion of the actuator arm; and a hollow sleeve configured to accept the actuator extension therein, the hollow sleeve attached at the top end of the frame and comprising at least one hole to accept a pin; and one or more adjustment holes along the length of the actuator extension, the one or more adjustment holes configured to accept the pin;

wherein the actuator extension is secured at a desired position by inserting the pin into the at least one hole of the hollow sleeve and at least one of the one or more adjustment holes of the actuator extension.

10. The hip flexor of claim 9 further comprising a collar configured to accept a horizontal member of the frame and move along the horizontal member of the frame, the collar having the hollow sleeve attached thereto.

11. The hip flexor of claim 9 further comprising:

a first track attached to the actuator arm;

at least one first track attachment on the first track, the first track attachment being adjustable along the first track;

a second track attached to the frame; and at least one second track attachment on the second track, the second track attachment being adjustable along the second track;

wherein the one or more resistance devices are attached to the actuator arm and the frame by the first track attachment and the second track attachment.

12. The hip flexor of claim 9 further comprising a pad attached to the actuator arm.

13. The hip flexor of claim 12 further comprising:

a guide configured to accept the actuator arm therein, the guide being movable along the length of the actuator arm and comprising at least one hole to accept a pin;

one or more adjustment holes along the length of the actuator arm, the one or more adjustment holes configured to accept the pin;

wherein the pad is attached to the guide and secured at a desired position by inserting the pin into the at least one hole of the guide and at least one of the one or more adjustment holes of the actuator arm.

14. A hip flexor comprising:

a frame comprising a top end, a bottom end, and one or more frame attachments;

an actuator extension at the top end of the frame, the actuator extension extending downward;

an actuator arm attached to the actuator extension by a pivot, the actuator arm comprising one or more actuator attachments;

one or more resistance devices attached to the one or more frame attachments and the one or more actuator attachments, wherein the one or more resistance devices resist motion of the actuator arm;

a first track attached to the actuator arm;

at least one first track attachment on the first track, the first track attachment being adjustable along the first track;

a second track attached to the frame; and at least one second track attachment on the second track, the second track attachment being adjustable along the second track;

wherein the one or more resistance devices are attached to the actuator arm and the frame by the first track attachment and the second track attachment.

15. The hip flexor of claim 14 further comprising:

a hollow sleeve configured to accept the actuator extension therein, the hollow sleeve attached at the top end of the frame and comprising at least one hole to accept a pin; and one or more adjustment holes along the length of the actuator extension, the one or more adjustment holes configured to accept the pin;

wherein the actuator extension is secured at a desired position by inserting the pin into the at least one hole of the hollow sleeve and at least one of the one or more adjustment holes of the actuator extension.

16. The hip flexor of claim 15 further comprising a collar configured to accept a horizontal member of the frame and move along the horizontal member of the frame, the collar having the hollow sleeve attached thereto.

17. The hip flexor of claim 14 further comprising a pad attached to the actuator arm.

18. The hip flexor of claim 17 further comprising:

a guide configured to accept the actuator arm therein, the guide being movable along the length of the actuator arm and comprising at least one hole to accept a pin;

one or more adjustment holes along the length of the actuator arm, the one or more adjustment holes configured to accept the pin;

wherein the pad is attached to the guide and secured at a desired position by inserting the pin into the at least one hole of the guide and at least one of the one or more adjustment holes of the actuator arm.

19. A hip flexor comprising:

a frame comprising a top end, a bottom end, and one or more frame attachments;

an actuator extension at the top end of the frame, the actuator extension extending downward;

an actuator arm attached to the actuator extension by a pivot, the actuator arm comprising one or more actuator attachments;

one or more resistance devices attached to the one or more frame attachments and the one or more actuator attachments, wherein the one or more resistance devices resist motion of the actuator arm; and a pad attached to the actuator arm.

20. The hip flexor of claim 19 further comprising:

a hollow sleeve configured to accept the actuator extension therein, the hollow sleeve attached at the top end of the frame and comprising at least one hole to accept a pin; and one or more adjustment holes along the length of the actuator extension, the one or more adjustment holes configured to accept the pin;

wherein the actuator extension is secured at a desired position by inserting the pin into the at least one hole of the hollow sleeve and at least one of the one or more adjustment holes of the actuator extension.

21. The hip flexor of claim 20 further comprising a collar configured to accept a horizontal member of the frame and move along the horizontal member of the frame, the collar having the hollow sleeve attached thereto.

22. The hip flexor of claim 19 further comprising:

a first track attached to the actuator arm;

at least one first track attachment on the first track, the first track attachment being adjustable along the first track;

a second track attached to the frame; and at least one second track attachment on the second track, the second track attachment being adjustable along the second track;

wherein the one or more resistance devices are attached to the actuator arm and the frame by the first track attachment and the second track attachment.

23. The hip flexor of claim 19 further comprising:

a guide configured to accept the actuator arm therein, the guide being movable along the length of the actuator arm and comprising at least one hole to accept a pin;

one or more adjustment holes along the length of the actuator arm, the one or more adjustment holes configured to accept the pin;

wherein the pad is attached to the guide and secured at a desired position by inserting the pin into the at least one hole of the guide and at least one of the one or more adjustment holes of the actuator arm.

* * * * *